US010975611B2

(12) United States Patent
Kendall et al.

(10) Patent No.: US 10,975,611 B2
(45) Date of Patent: Apr. 13, 2021

(54) ASTRAGAL

(71) Applicant: Endura Products, Inc., Colfax, NC (US)

(72) Inventors: Adam Kendall, Greensboro, NC (US); Tomasz Jaskiewicz, Oak Ridge, NC (US)

(73) Assignee: Endura Products, LLC, Colfax, NC (US)

( * ) Notice: Subject to any disclaimer, the term of this patent is extended or adjusted under 35 U.S.C. 154(b) by 1141 days.

(21) Appl. No.: 15/286,897

(22) Filed: Oct. 6, 2016

(65) Prior Publication Data

US 2018/0100346 A1 Apr. 12, 2018

(51) Int. Cl.
*E06B 3/36* (2006.01)
*E05C 7/04* (2006.01)

(52) U.S. Cl.
CPC ..... *E06B 3/365* (2013.01); *E05C 7/045* (2013.01); *Y10T 292/0894* (2015.04); *Y10T 292/68* (2015.04)

(58) Field of Classification Search
CPC ..... Y10T 292/68; Y10T 292/705; Y10T 292/707; Y10T 292/0894; E05C 7/045; E06B 3/365
See application file for complete search history.

(56) References Cited

U.S. PATENT DOCUMENTS

| | | | | | |
|---|---|---|---|---|---|
| 2,565,636 | A | * | 8/1951 | Tinnerman | F16B 2/241 292/76 |
| 3,649,060 | A | | 3/1972 | Ruff | |
| 4,058,332 | A | | 11/1977 | DiFazio | |
| 4,492,397 | A | | 1/1985 | Allenbaugh | |
| 4,925,041 | A | * | 5/1990 | Pehr | B65D 43/164 215/216 |
| 5,137,260 | A | * | 8/1992 | Pehr | B65D 43/164 215/216 |
| 5,231,948 | A | * | 8/1993 | Malmanger | B63B 19/16 114/201 R |

(Continued)

FOREIGN PATENT DOCUMENTS

| | | | | | |
|---|---|---|---|---|---|
| DE | 2531685 | | * | 2/1976 | |
| EP | 1471196 | A1 | * | 10/2004 | E05C 1/04 |
| GB | 967947 | A | * | 8/1964 | E05C 1/04 |

OTHER PUBLICATIONS

Examination Report for Canadian Patent Application No. 2976794, dated Nov. 22, 2018, 4 pgs.

(Continued)

*Primary Examiner* — Carlos Lugo
(74) *Attorney, Agent, or Firm* — Womble Bond Dickinson (US) LLP

(57) ABSTRACT

Retainers for use within an astragal assembly as described. The astragal assembly has an astragal body with a major axis. The astragal assembly is for use in a double door entryway unit. The retainers include a retention portion configured to engage an entryway component and a mounting portion configured for placement onto the astragal body in a direction normal to the major axis. The retention portion is either a void for receiving at least one of a latch and a deadbolt, or the retention portion is a bolt pin configured to engage an entryway frame.

14 Claims, 11 Drawing Sheets

(56) References Cited

U.S. PATENT DOCUMENTS 5,328,217 A * 7/1994 Sanders ..... E05B 15/0245 292/341.19
5,335,450 A 8/1994 Procton
5,350,207 A 9/1994 Sanders
5,671,958 A * 9/1997 Szapucki ..... E05C 1/10 292/175
5,857,291 A 1/1999 Headrick
5,897,147 A * 4/1999 Alyanakian ..... E05B 17/0004 292/153
6,183,024 B1 * 2/2001 Schultz ..... E05B 9/08 292/175
6,283,512 B1 * 9/2001 Butterbaugh ..... E05C 19/06 24/453
6,453,616 B1 9/2002 Wright
6,457,751 B1 * 10/2002 Hartman ..... E05B 17/2053 292/137
6,491,326 B1 12/2002 Massey et al.
6,905,152 B1 * 6/2005 Hudson ..... E05C 1/065 292/143
7,000,959 B2 2/2006 Sanders
7,096,626 B2 * 8/2006 Heng ..... E05B 9/08 292/175
7,140,650 B2 * 11/2006 Berg ..... E05C 19/06 292/67
7,494,163 B2 * 2/2009 Monts de Oca ..... E05C 1/06 292/139
7,513,539 B2 4/2009 Phipps
7,543,860 B2 * 6/2009 Meeks ..... E05C 1/04 292/137
7,591,103 B2 * 9/2009 Tremble ..... E05B 9/08 292/DIG. 47
7,878,559 B2 * 2/2011 Meeks ..... E05C 1/04 292/137
7,905,058 B2 3/2011 Massey et al.
8,806,809 B1 * 8/2014 Lawrence ..... E05D 13/06 292/338
8,978,303 B1 * 3/2015 Rogers ..... E05D 15/22 292/175
9,051,763 B2 6/2015 Taylor et al.
2005/0127692 A1 6/2005 Sanders
2005/0193784 A1 9/2005 Sanders
2012/0001443 A1 1/2012 Mitchell

OTHER PUBLICATIONS

Masonite Astragal, www.masonite.com, known at least as early as Apr. 11, 2016, 3 pgs.
Astragal slide bolt, All About Doors, www.allaboutdoors .com/product_info.php?products_id=362204, known at least as early as May 5, 2016, 3 pgs.
Wii battery compartment cover, www.focalprice.com/gw134w/Repacement_battery_Cover_for_Wii_Remote_Control, known at least as early as May 10, 2016, 1 pg.

* cited by examiner

ASTRAGAL

FIELD OF THE PRESENT DISCLOSURE

The present disclosure relates to entryway components, particularly entryway components that assist with retaining either a passive door or an active door within a double door entryway unit. More particularly, the present disclosure relates to astragals and components thereof.

BACKGROUND

French door, or double door, entryway units are popular in commercial and residential settings for their pleasing aesthetics and functional practicality. The optional ability to open a secondary (i.e. passive) door panel greatly increases the ability for ingress and egress of persons and household items.

As seen in FIG. 1, a French door entryway 10 traditionally includes a passive door panel 12, and an adjacent active door panel 14. The set of door panels may swing inwardly (as shown in FIG. 1) into the structure (so-called "inswing" doors), or may swing outwardly from the structure (so-called "outswing" doors). The passive door panel 12 typically includes an astragal 16 mounted along the entire extent of a non-hinged vertical edge (stile) of the passive door panel. In its most simple form, the astragal 16 may be little more than molding attached to the passive door panel 12 to act as a stop for the active door panel 14. More recently, astragals 16 have taken the form of assemblies mounted to the stile of the passive door panel 12, which have a significant role in the structural and weatherproofing performance of the entryway 10. The astragal 16 has a role in securing the passive door panel 12 in place using conventional flush bolts 18 to extend upward into a header 20 and downward into a sill 22 of an entryway frame 24. Astragals 16 often include seals, such as weatherstrips, to prevent the infiltration of moisture into the building. Further, astragals 16 are often configured to interact with latches 26 or deadbolts 28 extending from the non-hinged vertical edge of the active door 14 to help retain the active door in a closed position.

SUMMARY

Embodiments of the present disclosure include a retainer for use within an astragal assembly. The astragal assembly has an astragal body with a major axis. The astragal assembly is for use in a double door entryway unit. The retainer comprises a retention portion configured to engage an entryway component and a mounting portion configured for placement onto the astragal body in a direction normal to the major axis. The retention portion is either a void for receiving at least one of a latch and a deadbolt, or the retention portion is a bolt pin configured to engage an entryway frame.

Other embodiments of the present disclosure include astragal assemblies comprising an astragal body defining a longitudinal channel extending parallel with a major axis of the astragal body. When viewed along the major axis, the longitudinal channel is substantially defined by a back wall, a pair of opposed side walls, and at least one leg extending inwardly from one side wall toward an opposite side wall. The astragal assembly also includes at least one retainer. The at least one retainer comprises a retention portion configured to engage an entryway component, and a mounting portion having at least one biased member configured to compress to facilitate placement of the mounting portion at least partially within the longitudinal channel from a direction normal to the major axis.

Yet other embodiments of the present disclosure include methods of assembling an astragal assembly. The methods include acquiring an astragal body defining a longitudinal channel extending parallel with a major axis of the astragal body. When viewed along the major axis, the longitudinal channel is substantially defined by a back wall and a pair of opposed side walls. The methods also include installing at least one retainer onto the astragal body from a direction normal to the major axis. The at least one retainer comprises a retention portion configured to engage an entryway component, and a mounting portion configured to attach the at least one retainer to the astragal body. The retention portion is either a void for receiving at least one of a latch and a deadbolt, or the retention portion is a bolt pin configured to engage an entryway frame.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 1:
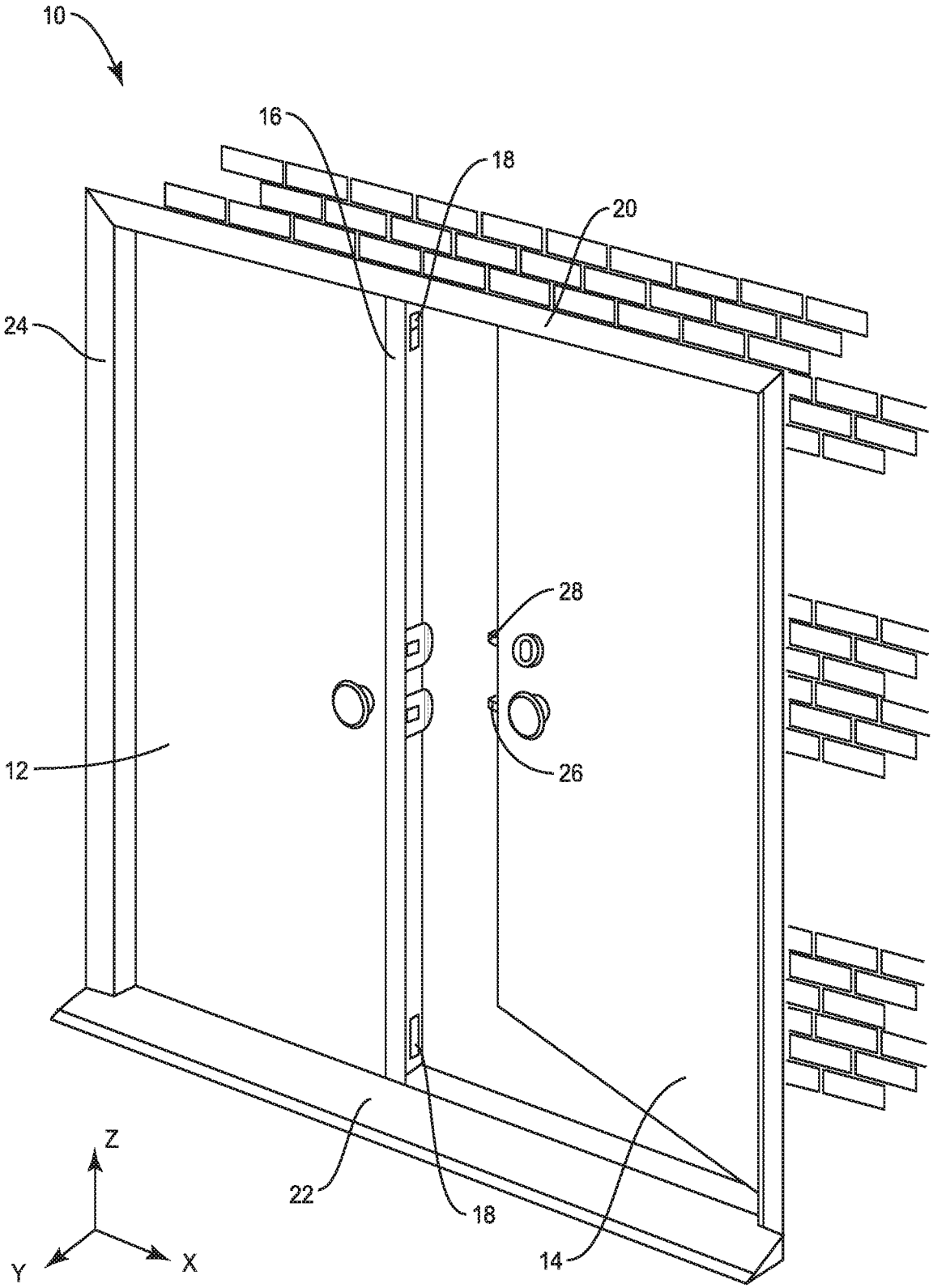
FIG. 1 PRIOR ART
FIG. 1 is an elevation view of a typical double door entryway unit.
Figure 2:
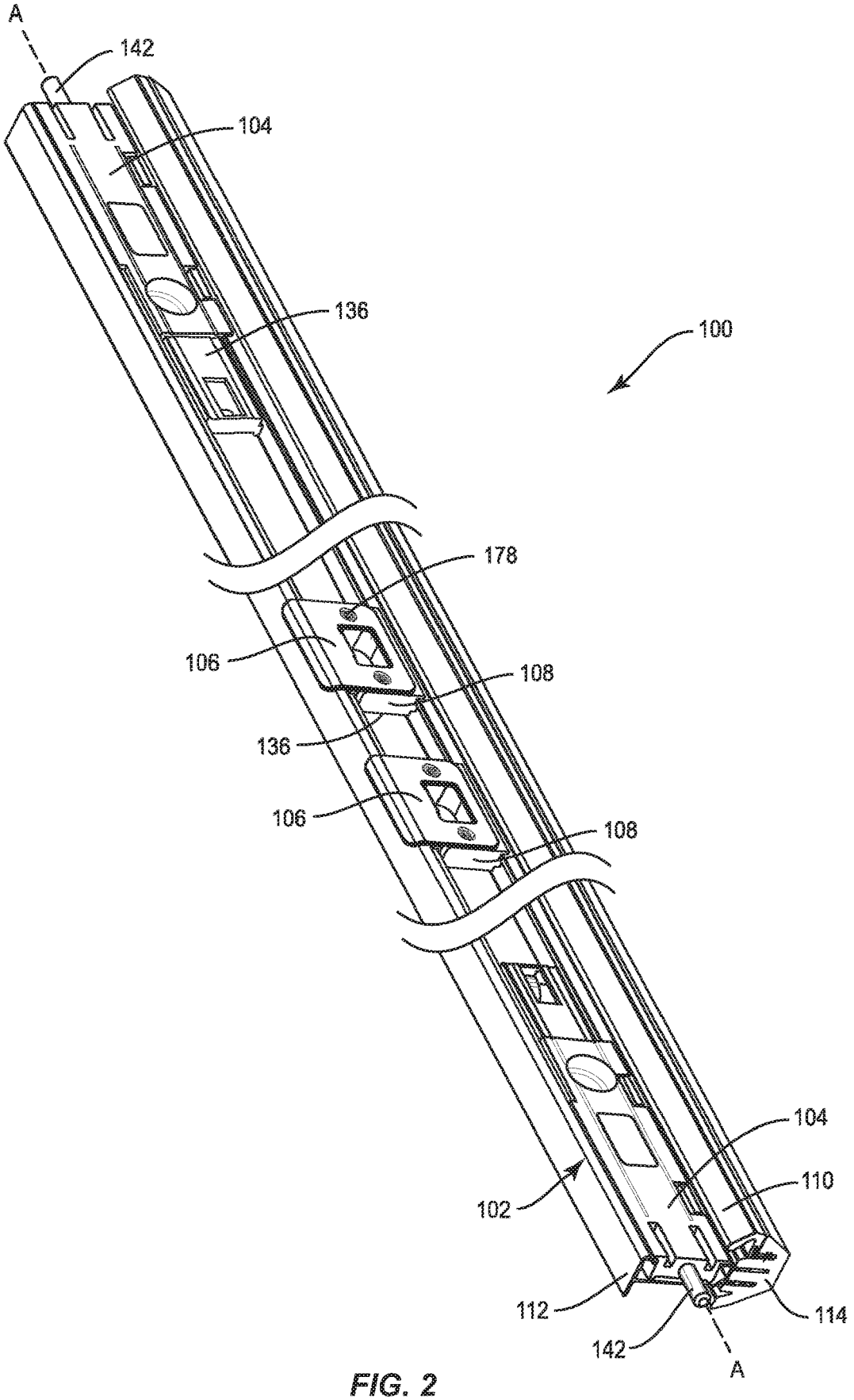
FIG. 2 is a partial assembly view of an astragal assembly according to embodiments of the present disclosure.

Turning to FIG. 2, an astragal assembly 100 is shown according to embodiments of the present disclosure. The astragal assembly 100 includes an astragal body 102. The astragal assembly 100 may include at least one flush bolt 104. Often an astragal assembly 100 will include a flush bolt 104 near the top of the astragal body 102 and another flush bolt 104 near the bottom of the astragal body. The flush bolts 104 may have a top bolt version and a bottom bolt version as shown. Alternatively, the flush bolts 104 may be designed for use on both the top and bottom of the astragal body 102, thereby reducing the number of unique components for the astragal assembly 100. The flush bolts 104 are used to secure the passive door 12 (FIG. 1) in a closed position relative to the entryway frame 24 (FIG. 1). The present disclosure is not limited to having two flush bolts 104. Certain embodiments of the present disclosure do not include flush bolts 104 at all.

The astragal assembly 100 may also include at least one strike plate 106. At least some of the strike plates 106 may be installed as part of the astragal assembly 100 with the use of one or more strike plate bases 108. The number and location of the strike plates 106 and the strike plate bases 108 may depend on the lock mechanism installed on the active door 14 (FIG. 1). A conventional set of locking hardware may include a deadbolt 28 and a latch 26 in close proximity as shown in FIG. 1. A strike plate 106 may be used with the deadbolt 28 and the latch 26 respectively. This is the configuration illustrated in FIG. 2. In another example, a multipoint lock may have three latches spaced along the non-hinged vertical edge of the active door. The latches of the multipoint lock may each double as a deadbolt. For use with such a multipoint lock, three spaced apart strike plates 106 would be used along the astragal body 102.

The astragal assembly 100 may include additional optional components such as a weatherstrip 110 extending parallel with a major axis A of the astragal body 102. Trim covers (not shown) may also be attached to the astragal body 102 to provide the astragal assembly 100 with a finished appearance by hiding internal components. In the illustrated embodiment, the astragal body 102 comprises an elongate housing 112 and a head 114. In some embodiments the elongate housing 112 and the head 114 may be integral and both formed from metal.

Figure 3:
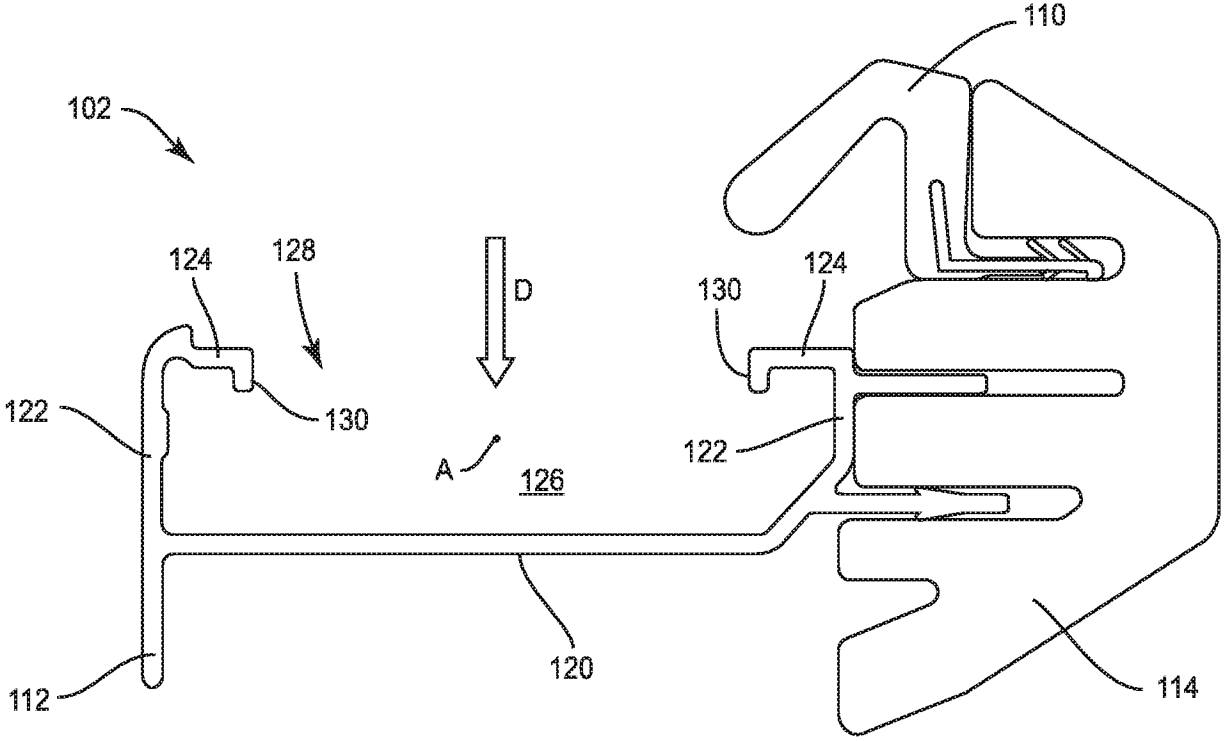
FIG. 3 is an end view of the astragal body of FIG. 2.
Figure 4:
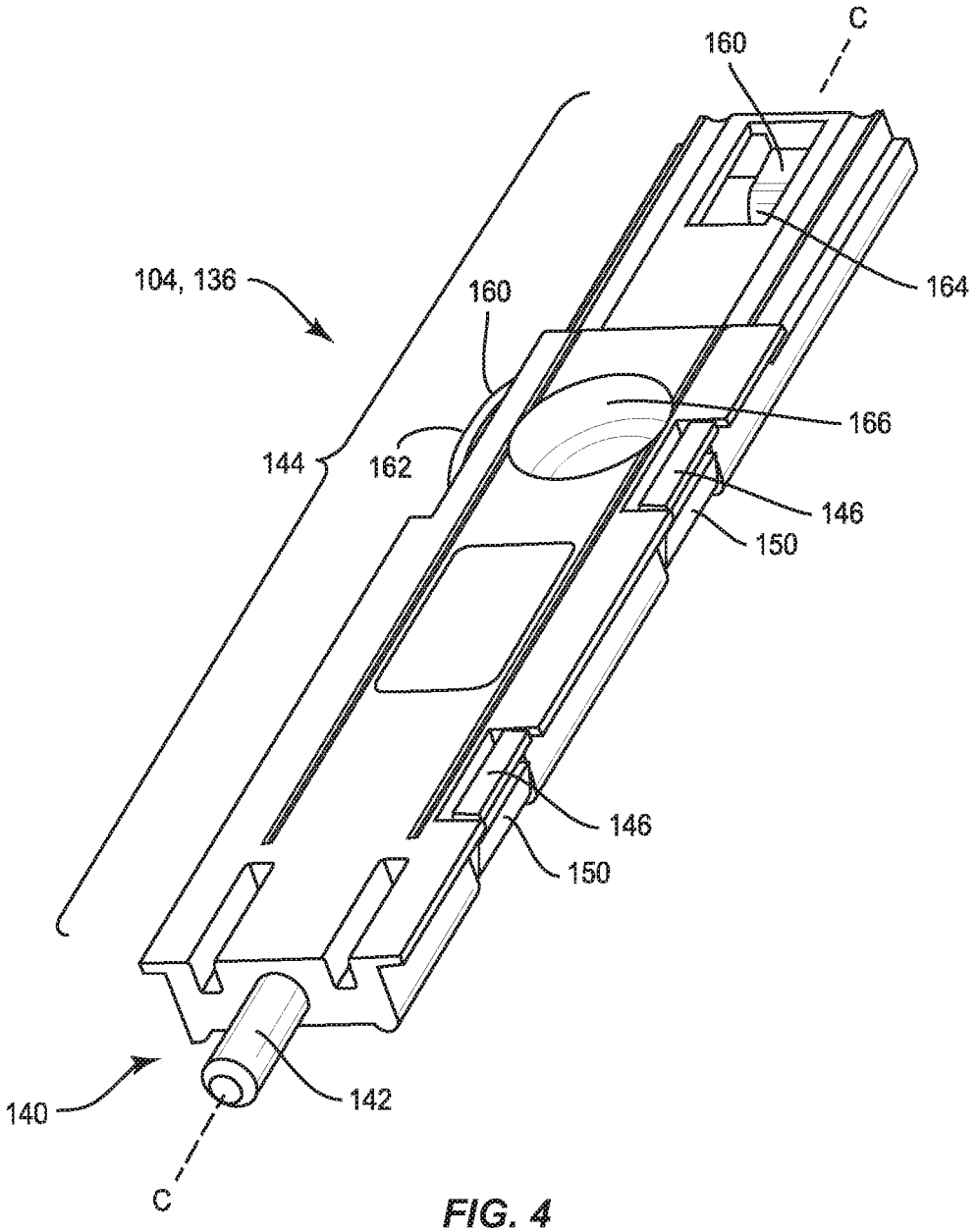
FIG. 4 is a front perspective of a flush bolt according to embodiments of the present disclosure.
Figure 5:
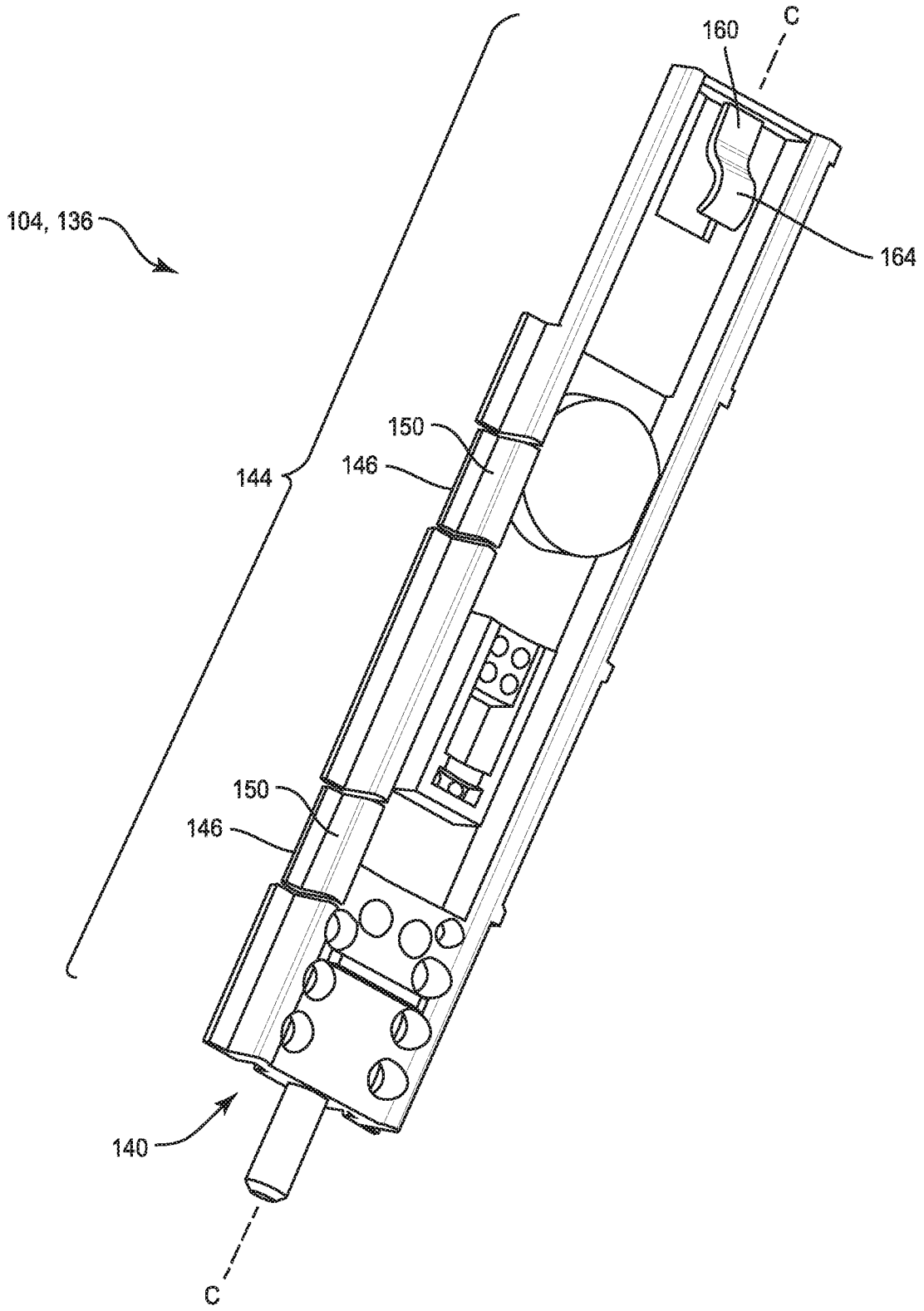
FIG. 5 is a rear perspective of the flush bolt of FIG. 4.

Turning to FIG. 3, an end view of the astragal body 102 is shown. Often the astragal body 102 is an elongated aluminum profile formed from by an extrusion process. In the illustrated embodiment, the elongate housing 112 is such an extrusion. The head 114 may be formed of wood, composite or polymer, and press fit onto the elongate housing 112. A lateral cross section of the astragal body 102 will be much the same no matter where along the major axis A of the astragal body 102 the cross section is taken. FIG. 3 shows the astragal body 102 as viewed along the major axis A thereof. The astragal body 102 includes a back wall 120. The back wall 120 is often mounted directly to the non-hinged vertical edge of the passive door 12 (FIG. 1). The back wall 120 may have one or more slots (not shown) for accepting fasteners that secure the astragal body 102 to the passive door. The slots may impact the true consistent nature of the astragal body's profile. A pair of opposed side walls 122 extend from the back wall 120. The side walls 122 may be substantially identical, or may vary slightly from one another, as shown. The ends of the side walls 122 may include opposed legs 124 that extend inwardly from the side walls 122 toward one another. The back wall 120, side walls 122 and opposed legs 124 at least partially enclose a longitudinal channel 126 that extends parallel with the major axis A. A gap 128 between opposed distal ends 130 of the opposed legs 124 provides access to the longitudinal channel 126 from a direction normal to the major axis A (see arrow D for example).

Referring back to FIG. 2, both the flush bolts 104 and the strike plate bases 108 may be referred to more generally as retainers 136. In other words, the flush bolt 104 is an example of a retainer 136. The flush bolt 104 has a retention function by retaining the passive door 12 (FIG. 1) in a closed position when the flush bolt 104 is in an extended position relative to the major axis A. The strike plate base 108 is also an example of a retainer 136. The strike plate base 108 also has a retention function by receiving at least one of a latch 26 and a deadbolt 28 so that the active door 14 (FIG. 1) is retained in its closed position. In prior astragals, similar retention components were assembled by sliding the retention components from the ends of the astragal. Instead, retainers 136 of the present disclosure are configured to be capable of attachment onto the astragal body 102 in a direction normal to the major axis A by at least partially passing through the gap 128 into the longitudinal channel 126.

With the retainers 136 capable of placement onto the astragal body 102 in a direction normal to the major axis A, the time required to create the astragal assembly 100 can be greatly reduced. Specifically, when the need to slide in retention components from the end of the astragal body 102 is eliminated, the order of assembly is significantly relaxed. Additionally, adding the retainers 136 as described herein, and similarly removing the retainers in a reverse fashion, significantly improves the ability to repair the astragal assembly 100. Specifically, removing worn or broken retention components can be done without removing the passive door 12 from the frame 24, or without removing the astragal assembly 100 from the passive door.

With reference to FIGS. 4-7, an example of a suitable flush bolt 104 is described in more detail. Similar to the conventional flush bolt 18 (FIG. 1), at least a portion of the flush bolt 104 is configured to translate relative to the major axis A of the astragal assembly 100 between a retracted position and an extended position. In the extended position, the flush bolt 104 is configured to engage one of the header 20 and the sill 22 of the entryway frame 24 (FIG. 1). The flush bolt 104 includes a retention portion 140 configured to engage an entryway component. Specifically, the retention portion 140 may be a bolt pin 142, and the entryway component to be engaged may be one of the header 20 or the sill 22 (FIG. 1).

The flush bolt 104 also includes a mounting portion 144 to attach the flush bolt to the astragal body 102. The mounting portion 144 is configured to facilitate the assembly of the flush bolt 104 at least partially into the longitudinal channel 126 of the astragal body 102 from a direction normal to the major axis A. Particularly, the mounting portion 144 is configured to removably fix the flush bolt 104 to the astragal body 102. Therefore, the flush bolt 104 can be assembled with the astragal body 102 and can later be removed from the astragal body, preferably by simply reversing an assembly process. Though the flush bolt 104 is configured to slide relative to the major axis A to extend and retract the bolt pin 142, the flush bolt 104 should remain fixed in its position along the major axis A unless acted on by an operator.

In one embodiment, the bolt pin 142 is metal, and the mounting portion 144 is a polymer material overmolded onto the bolt pin. In another embodiment, the bolt pin 142 and the mounting portion 144 are cast or molded integrally from the same material. In yet another embodiment the bolt pin 142 is capable of sliding relative to the mounting portion 144.

To facilitate assembly from the direction normal to the major axis A, the mounting portion 144 of the illustrated flush bolt 104 includes at least one biased member 146. The biased member 146 may be provided in the form of a spring clip. As possibly best seen in FIG. 7, the spring clip includes a resilient arm 150 configured to compress to allow placement of the mounting portion 144 at least partially within the longitudinal channel 126 from the direction normal to the major axis A. The resilient arm 150 is shown in a relaxed position in FIG. 7. Compression of the resilient arm 150 occurs with a pressing force F. At least a component of the pressing force F is directed toward a central axis C of the flush bolt 104. When compressed, a width W1 of the mounting portion 144 becomes sufficiently small to fit within the gap 128 (FIG. 3).

Figure 7:
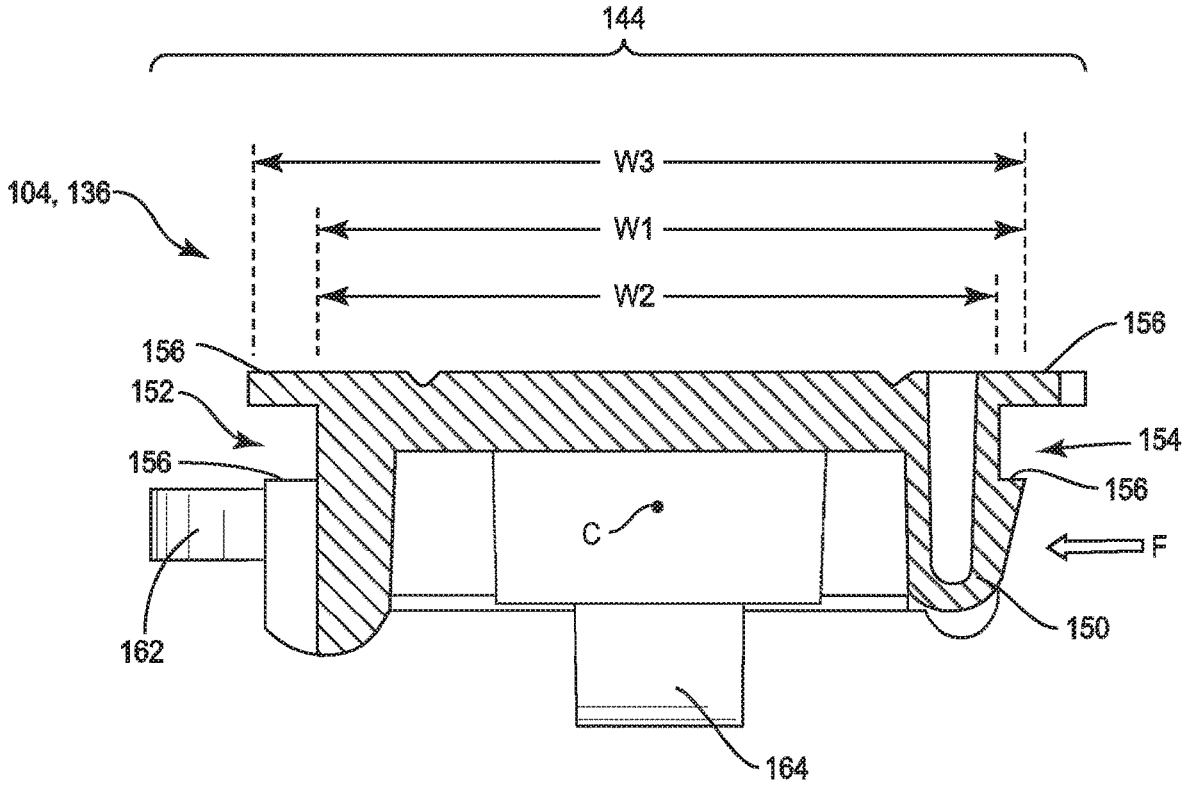
FIG. 7 is a cross sectional view of the flush bolt of FIG. 4 taken along line VII-VII of FIG. 6.
Figure 8:
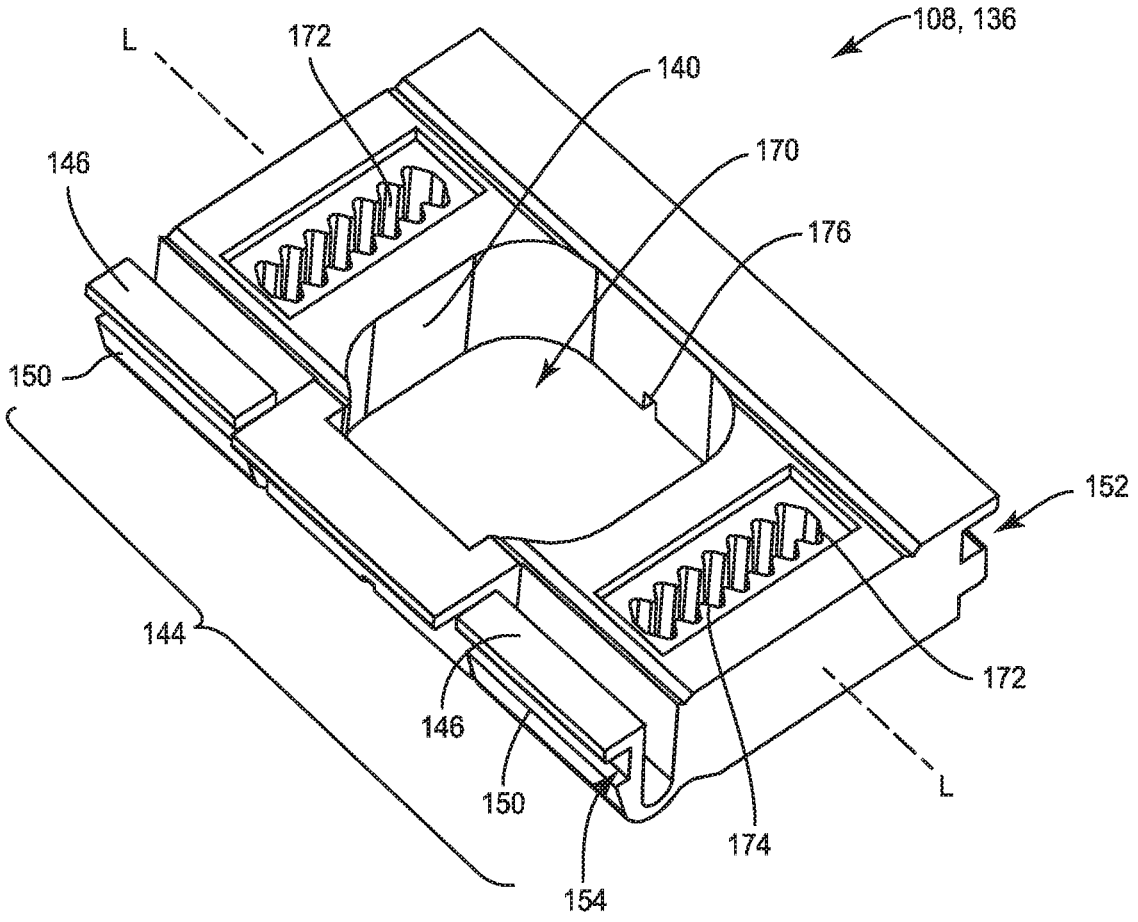
FIG. 8 is a front perspective of a strike plate base according to embodiments of the present disclosure.
Figure 9:
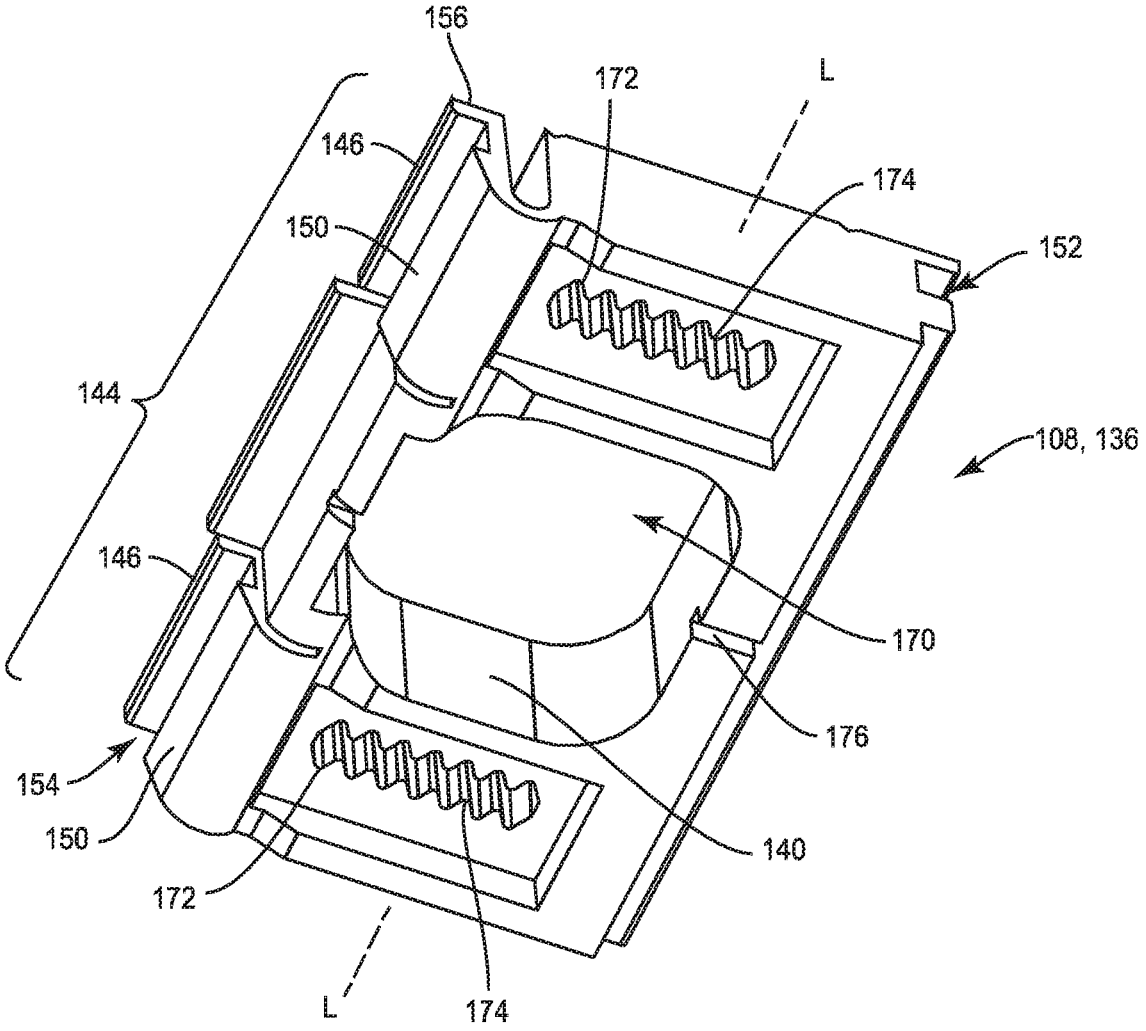
FIG. 9 is a rear perspective of the strike plate base of FIG. 8.
Figure 10:
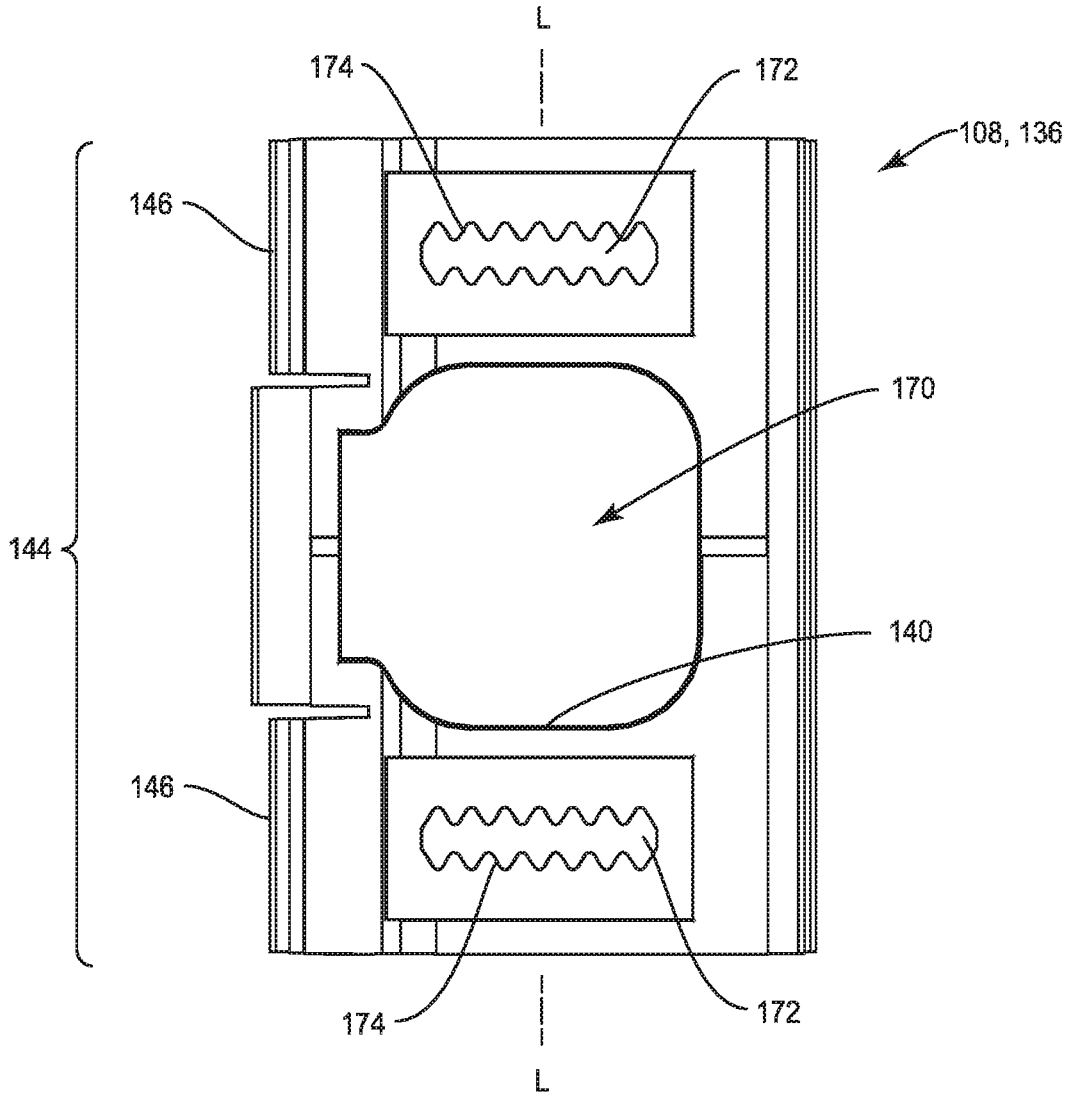
FIG. 10 is a front view of the strike plate base of FIG. 8.

Staying with FIG. 7, the mounting portion 144 of the flush bolt 104 may include a first guide slot 152 along one major edge thereof. The first guide slot 152 is configured to accept a distal end 130 of one of the opposed legs 124 when the flush bolt 104 is attached to the astragal body 102. The first guide slot 152 may be a fixed guide slot. The resilient arm 150 of the biased member 146 may form at least a portion of a second guide slot 154 along the other major edge of the mounting portion 144. The second guide slot 154 may be referred to as a sprung guide slot because the compression of the resilient arm 150 would flex the second guide slot 154 relative to the mounting portion 144. The second guide slot 154 is configured to accept a distal end 130 of a second leg of the opposed legs 124. The first and second guide slots 152, 154 provide a minimum width W2 therebetween that is smaller than the gap 128. The guide slots 152, 154 may include flanges 156 creating a third width W3 to prevent the flush bolt 104 from moving in a direction normal to the major axis A when the resilient arm 150 is in the relaxed position. The illustrated embodiment of the flush bolt 104 includes biased members 146 along a single major edge thereof. In another embodiment, one or more biased members 146 may be provided along each of the two major edges of the flush bolt 104. While the mounting portion 144 of the illustrated flush bolt 104 uses biased members 146 to create a first width W1 facilitating insertion and a third width W3 preventing removal, in other embodiments, the mounting portion 144 may be provided with this functionality from means other than spring clips. For example, a quarter-turn fastener could have a first position providing an insertion width and a second position providing a retention width.

Figure 6:
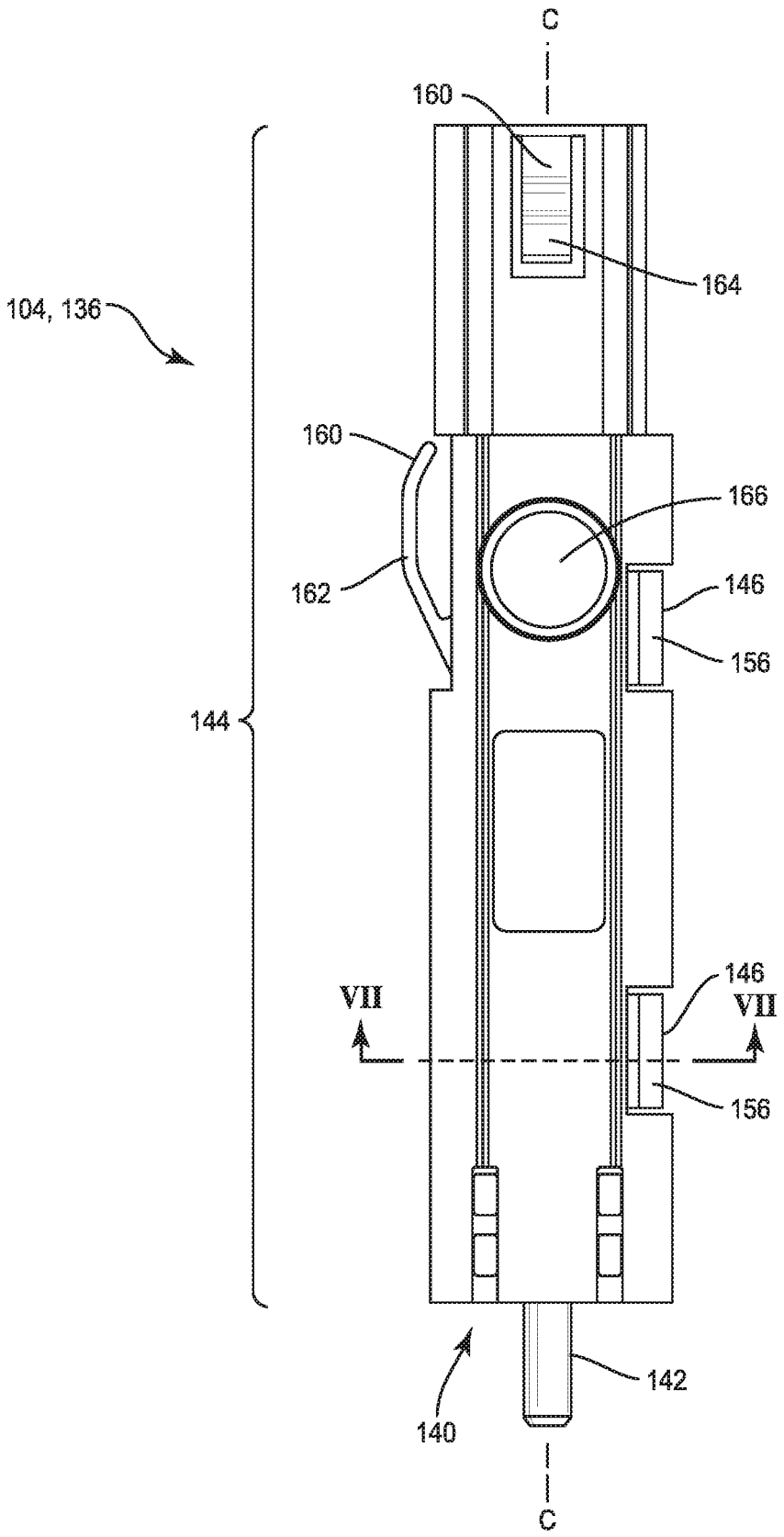
FIG. 6 is a front view of the flush bolt of FIG. 4.

As possibly best seen in FIG. 6, the flush bolt 104 may also include one or more friction springs 160 configured to assist with retaining the flush bolt 104 in a fixed position along the major axis A of the astragal body 102. A first friction spring 162 is illustrated along a major edge of the flush bolt 104. The first friction spring 162 is configured to contact and press against a respective one of the side walls 122 of the longitudinal channel 126 to provide a position maintaining force. A second friction spring 164 is a leaf spring extending from a back side of the flush bolt 104. The second friction spring 164 is configured to contact and press against the back wall 120 of the longitudinal channel 126 to provide another position maintaining force. The friction springs 160 may be molded from polymer and integral with the mounting portion 144 of the flush bolt 104.

The flush bolt 104 may also optionally include a finger pocket 166 formed in a front side thereof. The finger pocket 166 may be accessed by the operator and used for sliding the flush bolt 104 relative to the major axis A of the astragal body 102 between the retracted position and the extended position.

The flush bolt 104 may also optionally carry one or more sealing pads (not shown) attached to the flush bolt and traveling with the flush bolt from the retracted position to the extended position. The sealing pads may include a bottom sealing pad carried on the bottom of the flush bolt 104 and configured to help seal against the threshold 22. The sealing pads may include a corner sealing pad for sealing against the stile of the active door panel 14. A back sealing pad may be provided the rear of the flush bolt 104 opposite a corner sealing pad. When provided, the back sealing pad helps seal between the flush bolt 104 and an edge of the passive door panel by residing in an opening in the astragal body 102.

Turning now to FIGS. 8-11, details of the retainer 136 in the form of a strike plate base 108 are now further described. Similar to the flush bolt 104, the strike plate base 108 also includes a retention portion 140. The retention portion 140 of the strike plate base 108 is a void 170. The void 170 may be cavity, a blind hole or a through hole. The void 170 is configured to receive and at least assist with retaining at least one of a latch 26 and a deadbolt 28 extending from the non-hinged vertical edge of an active door 14 (FIG. 1).

The strike plate base 108 also includes a mounting portion 144 configured to allow the strike plate base to be placed along the longitudinal channel 126 of the astragal body 102 from a direction normal to the major axis A. As possibly best seen in the profile view of FIG. 11, the profile of the mounting portion 144 of the strike plate base 108 may be substantially similar to a cross section of the mounting portion 144 of the flush bolt 104. To facilitate assembly from the direction normal to the major axis A of the astragal body 102, the mounting portion 144 of the illustrated strike plate base 108 includes at least one biased member 146. The biased member 146 may be provided in the form of a spring clip. As possibly best seen in FIG. 11, the spring clip includes a resilient arm 150 configured to compress to allow placement of at least part of the mounting portion 144 within the longitudinal channel 126 from the direction normal to the major axis A. The resilient arm 150 is shown in a relaxed position in FIG. 11. Compression of the resilient arm 150 occurs with a pressing force F, which has at least a component toward the central axis L of the strike plate base 108. When compressed, a first width W1 of the mounting portion 144 becomes sufficiently small to fit within the gap 128 into the longitudinal channel 126 (FIG. 3).

Figure 11:
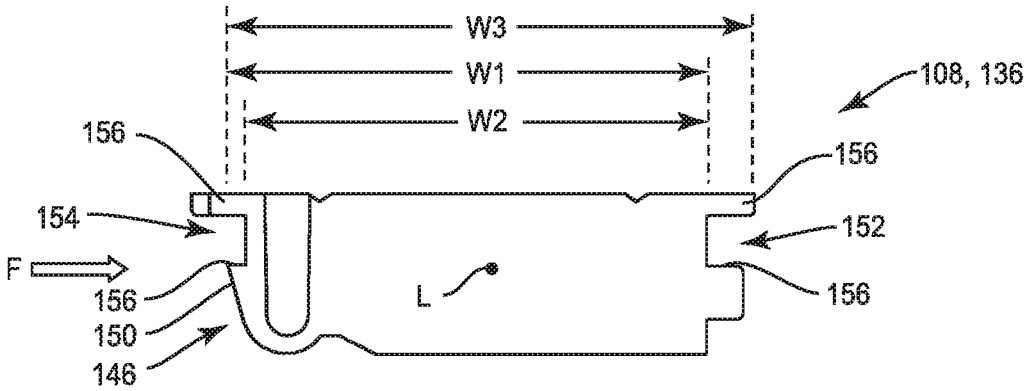
FIG. 11 is an end view of the strike plate base of FIG. 8.

Staying with FIG. 11, the mounting portion 144 of the strike plate base 108 may also include a first guide slot 152 along one major edge thereof. The first guide slot 152 is configured to accept a distal end 130 of one of the opposed legs 124 when the strike plate base 108 is attached to the astragal body 102. The first guide slot 152 may be a fixed guide slot. The resilient arm 150 of the biased member 146 may form at least a portion of a second guide slot 154 along the other major edge of the strike plate base 108. The second guide slot 154 may be referred to as a sprung guide slot because the compression of the resilient arm 150 would flex the second guide slot 154 relative to the central axis L. The second guide slot 154 is configured to accept a distal end 130 of a second of the opposed legs 124. The first and second guide slots 152, 154 provide a minimum width W2 therebetween that is smaller than the gap 128. The guide slots 152, 154 include flanges 156 that provide a third width W3 to prevent the strike plate base 108 from moving in a direction normal to the major axis A when the resilient arm 150 is in the relaxed position. The illustrated embodiment of the strike plate base 108 includes biased members 146 along a single major edge thereof. In another embodiment, one or more biased members 146 may be provided along each of the two major edges of the strike plate base 108. While the mounting portion 144 of the illustrated strike plate base 108 uses biased members 146 to create a first width W1 facilitating insertion and a third width W3 preventing removal, in other embodiments, the mounting portion 144 may be provided with this functionality from means other than spring clips. For example, a quarter-turn fastener could have a first position providing an insertion width and a second position providing a retention width.

Returning to FIGS. 8-10, the strike plate base 108 may include an elongated convoluted slot 172 adjacent to two opposite sides of the void 170. The convoluted slots are configured to receive fasteners for attaching a strike plate 106 (FIG. 2) to the strike plate base 108. The convoluted slots 172 allow for a plurality of possible receiving regions 174 arranged along an interior/exterior direction (see the Y-axis in FIG. 1). The plurality of receiving regions 174 allow the strike plate base 108 to accept a plurality of strike plates 106 and to allow for the correct positioning of the strike plate 106 along the interior/exterior direction of the double door entryway unit 10.

The strike plate base 108 may also include an optional line of weakness 176 that bisects the void 170 to help the installer divide the strike plate base 108 in half. Alternatively, a demarcation may be provided that designates the bisector of the void 170 and provides an indication of the preferred location for cutting the strike plate base 108 in two. Assisting with dividing the strike plate base 108 may be beneficial because some strike plates 106 may have a larger distance between their attachment locations in a direction along the major axis A.

The strike plate base 108 may maintain its position along the major axis A when installed with the astragal body 102. In one embodiment, the fasteners 178 (FIG. 2) used to mount the strike plate 106 to the strike plate base 108 may simultaneously maintain the position of the strike plate and strike plate base relative to the major axis A. In another embodiment, other components, such as the trim covers (not shown) may assist with maintaining the position of the strike plate base 108 along the major axis A. In yet other embodiments, contact between the second guide slot 154 and the distal end 130 of the respective one of the opposed legs 124 may provide sufficient resistance to motion along the major axis A. Further still, one or more friction springs (not shown), similar to those used by the flush bolt 104, may be added to the strike plate base 108.

Figure 12A:
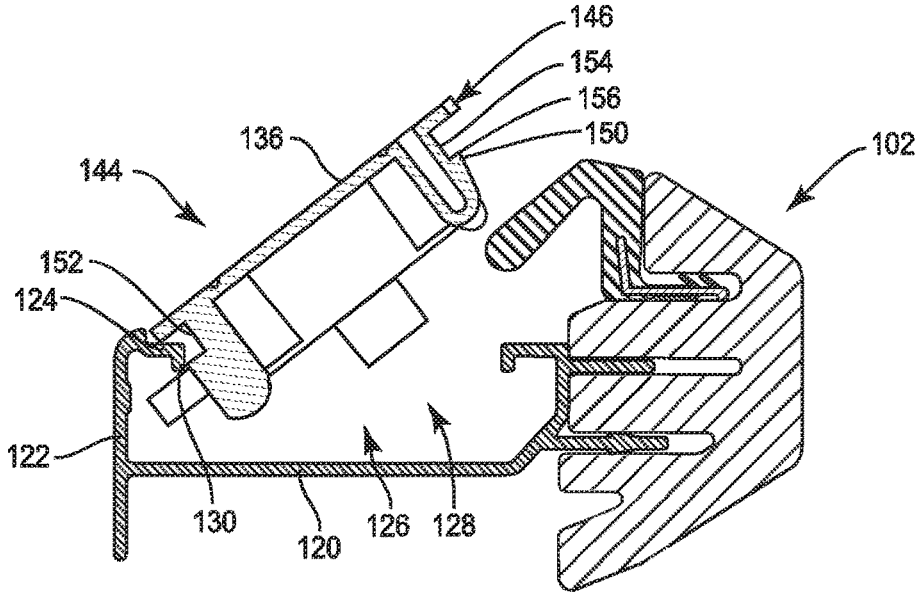
FIGS. 12A-12C illustrate the sequence for adding a retainer onto the astragal body to form an astragal assembly.
Figure 12B:
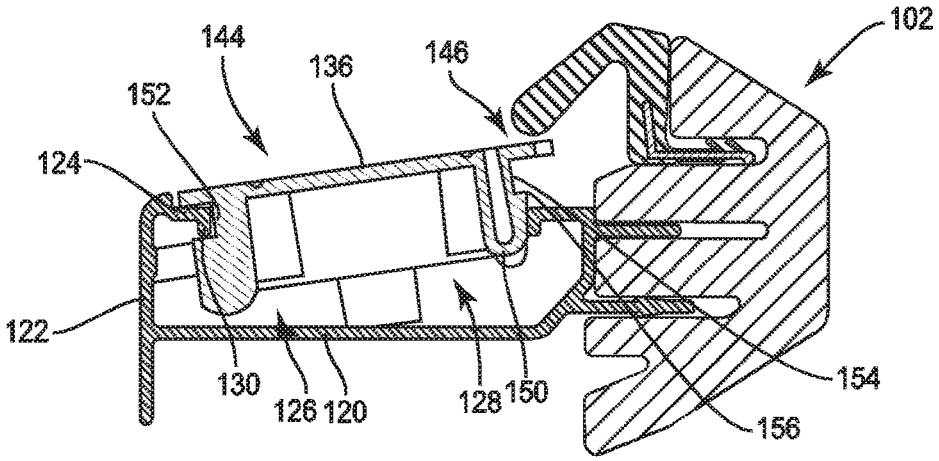
Figure 12C:
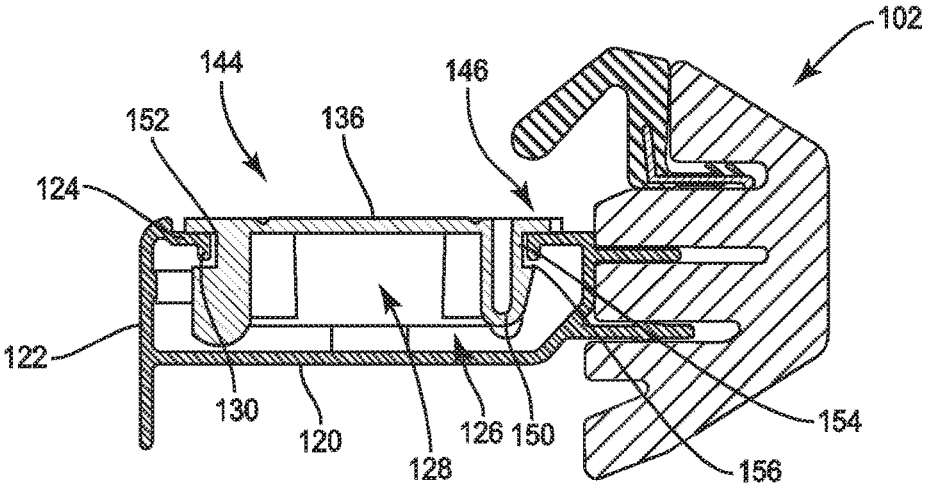

Turning to FIGS. 12A-12C, a sequence of actions for installing a retainer 136 onto the astragal body 102 is shown. In FIG. 12A, a first major edge of the retainer 136, such as the major edge with the first guide slot 152, is engaged with one of the opposed legs 124 extending from a side wall 122 that defines the longitudinal channel 126. As shown in FIG. 12A, the retainer 136 is inserted in a direction normal to the major axis of the astragal body. Specifically, the retainer 136 is inserted in a direction extending from the second guide slot 154 towards the first guide slot 152. FIG. 12B shows the retainer 136 rotated about the distal end 130 of the respective one of the opposed legs 124 toward the longitudinal channel 126. The distal end 130 of the second leg of the opposed legs 124 may contact and compress the resilient arm 150 of the biased member 146 in the direction extending from the second guide slot 154 towards the first guide slot 152 as shown. When the resilient arm 150 is compressed, a flange 156 of the second guide slot 154 is able to pass through the gap 128. The addition of the retainer 136 onto the astragal body 102 is completed as seen in FIG. 12C. The distal end 130 of the second leg of the opposed legs 124 is captured in the second guide slot 154 when the resilient arm 150 is released, returning to the relaxed position thereof. In addition, as the retainer 136 is inserted and rotated about the distal end 130, a spring of the retainer 136 adjacent the first guide slot 152, e.g., friction spring 162 (FIG. 6), may be compressed in a direction parallel to the direction extending from the second guide slot 154 towards the first guide slot 152.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

The invention claimed is:

1. A retainer for use within an astragal assembly having an astragal body having a longitudinal channel defining a major axis, the astragal assembly for use in a double door entryway unit, the retainer comprising:

a retention portion configured to engage an entryway component; and a mounting portion configured for placement onto the astragal body, the mounting portion having a first major edge and a second major edge opposite the first major edge, the first major edge including a fixed guide slot defined therealong and a first biased member, the mounting portion comprising a second biased member formed along the second major edge and configured to compress for placement of the mounting portion within the astragal body, the second biased member including a sprung guide slot defined therein in a direction parallel to the second major edge, the mounting portion configured to be secured to the astragal body by tilting the mounting portion with respect to a direction normal to the major axis such that a portion of a first sidewall of the astragal body is received in the fixed guide slot and rotating the mounting portion about the portion of the first sidewall received in the first guide slot until the sprung guide slot receives a portion of a second sidewall of the astragal body, the first biased member configured to contact the first sidewall, the mounting portion further comprising a friction spring configured to contact a back wall of the astragal body, wherein the retention portion is either a void for receiving at least one of a latch and a deadbolt, or the retention portion is a bolt pin configured to engage an entryway frame.

2. The retainer of claim 1, wherein the mounting portion is configured to be removably fixed to the astragal body.

3. The retainer of claim 1, wherein the at least one biased member is at least one spring clip.

4. The retainer of claim 1, wherein the retention portion is a void for receiving at least one of a latch and a deadbolt.

5. The retainer of claim 4, further comprising an elongated convoluted slot adjacent to two opposite sides of the void to receive fasteners for attaching a strike plate to the retainer.

6. The retainer of claim 5, further comprising a line of weakness bisecting the void to designate a line for dividing the retainer.

7. The retainer of claim 1, wherein the retention portion is a bolt pin configured to engage an entryway frame.

8. The retainer of claim 7, further comprising at least one friction spring configured to create a position maintaining force to help keep the retainer in position along the major axis of the astragal body.

9. The retainer of claim 7, further comprising a finger pocket for use when sliding the retainer along the major axis of the astragal body between an extended position and a retracted position.

10. An astragal assembly, comprising:

an astragal body defining a longitudinal channel extending parallel with a major axis of the astragal body, when viewed along the major axis, the longitudinal channel is substantially defined by a back wall, a pair of opposed side walls, and a pair of legs extending inwardly toward one another from the opposed side walls, a gap between opposed ends of the pair of legs provides access to the longitudinal channel in a direction normal to the major axis; and a retainer according to claim 1.

11. The astragal assembly of claim 10, wherein the retainer comprises at least three retainers, the at least three retainers comprise:

a first flush bolt arranged adjacent to a top of the astragal body, a second flush bolt arranged adjacent to a bottom of the astragal body, and at least one strike plate base positioned between the first and second flush bolts.

12. An astragal assembly comprising:

an astragal body defining a longitudinal channel extending parallel with a major axis of the astragal body, when viewed along the major axis, the longitudinal channel is substantially defined by a back wall, a pair of opposed side walls, and at least one leg extending inwardly from one side wall toward an opposite side wall; and at least one retainer, the at least one retainer comprising:

a retention portion configured to engage an entryway component; and a mounting portion having a first major edge and a second major edge opposite the first major edge, the first major edge including a fixed guide slot defined therealong and a first biased member, the mounting portion having a second biased member formed along the second major edge and configured to compress to facilitate placement of the mounting portion, the second biased member including a sprung guide slot defined therein in a direction parallel to the second major edge, the mounting portion configured to be secured to the astragal body by tilting the mounting portion with respect to a direction normal to the major axis such that a portion of a first sidewall of the astragal body is received in the fixed guide slot and rotating the mounting portion about the portion of the first sidewall received in the first guide slot until the sprung guide slot receives a portion of a second sidewall of the astragal body, the first biased member being configured to contact the first sidewall the mounting portion further comprising a friction spring configured to contact the back wall of the astragal body.

13. The astragal assembly of claim 12, wherein the at least one retainer comprises at least a first retainer, a second retainer and a third retainer, wherein the first retainer is a first flush bolt, the first flush bolt is arranged adjacent to a top of the astragal body, and the retention portion thereof is a bolt pin for engaging a header, wherein the second retainer is a second flush bolt, the second flush bolt is arranged adjacent to a bottom of the astragal body, and the retention portion thereof is a bolt pin for engaging a sill, and wherein the third retainer is positioned between the first and second flush bolts, and the retention portion thereof is a void for engaging one of a latch and a deadbolt.

14. A method of assembling an astragal assembly, comprising:

acquiring an astragal body defining a longitudinal channel extending parallel with a major axis of the astragal body, when viewed along the major axis, the longitudinal channel is substantially defined by a back wall, a first side wall, and a second side wall;

installing at least one retainer onto the astragal body by tilting the mounting portion with respect to a direction normal to the major axis, wherein the at least one retainer comprises:

a first major edge;

a second major edge;

a retention portion configured to engage an entryway component; and a mounting portion configured to attach the at least one retainer to the astragal body, wherein the retention portion is either a void for receiving at least one of a latch and a deadbolt, or the retention portion is a bolt pin configured to engage an entryway frame;

receiving a portion of the first side wall in a fixed guide slot defined along the second major edge of the mounting portion, a first biased member disposed along the second major edge of the mounting portion;

rotating the mounting portion about the fixed guide slot until a sprung guide slot defined in a second biased member formed along the second major axis of the mounting portion receives a portion of the second side wall; and compressing the first biased member and a first friction spring to allow the second major edge of the mounting portion to at least partially enter the longitudinal channel as the mounting portion is rotated about the fixed guide slot, the first friction spring extending from the mounting portion to engage the back wall of the astragal body.

* * * * *